US009080451B2

(12) United States Patent
Simpson et al.

(10) Patent No.: US 9,080,451 B2
(45) Date of Patent: Jul. 14, 2015

(54) AIRFOIL

(75) Inventors: Stanley Frank Simpson, Simpsonville, SC (US); Benjamin Paul Lacy, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 547 days.

(21) Appl. No.: 13/535,540

(22) Filed: Jun. 28, 2012

(65) Prior Publication Data

US 2014/0003960 A1 Jan. 2, 2014

(51) Int. Cl.
*F01D 5/18* (2006.01)

(52) U.S. Cl.
CPC ..... *F01D 5/186* (2013.01); *F01D 5/187* (2013.01); *F05D 2240/305* (2013.01); *F05D 2240/306* (2013.01); *F05D 2260/202* (2013.01); *F05D 2260/204* (2013.01)

(58) Field of Classification Search
CPC ..... F01D 5/187; F01D 5/142; F01D 25/125; F05D 2240/305; F05D 2240/306; F05D 2260/202
USPC ..... 416/97 R; 415/115
See application file for complete search history.

(56) References Cited

U.S. PATENT DOCUMENTS

| | | | | |
|---|---|---|---|---|
| 5,374,162 | A | 12/1994 | Green | |
| 5,458,461 | A | 10/1995 | Lee et al. | |
| 6,050,777 | A | 4/2000 | Tabbita et al. | |
| 6,210,111 | B1 | 4/2001 | Liang | |
| 6,210,112 | B1 | 4/2001 | Tabbita et al. | |
| 6,994,521 | B2 * | 2/2006 | Liang | 416/97 R |
| 8,087,893 | B1 | 1/2012 | Liang | |
| 8,105,030 | B2 * | 1/2012 | Abdel-Messeh et al. | 416/95 |
| 8,870,535 | B2 * | 10/2014 | Lacy | 416/97 R |
| 8,870,536 | B2 * | 10/2014 | Lacy | 416/97 R |
| 2010/0040478 | A1 | 2/2010 | Abdel-Messeh et al. | |
| 2011/0097188 | A1 | 4/2011 | Bunker | |

FOREIGN PATENT DOCUMENTS

| | | |
|---|---|---|
| EP | 1013877 A2 | 6/2000 |
| EP | 2154333 A2 | 2/2010 |

OTHER PUBLICATIONS

Search Report from EP Application No. 13172933.7 dated Sep. 16, 2013.

* cited by examiner

*Primary Examiner* — Ninh H Nguyen
(74) *Attorney, Agent, or Firm* — Dority & Manning, PA

(57) ABSTRACT

An airfoil includes an interior surface, an exterior surface opposed to the interior surface, a pressure side, a suction side opposed to the pressure side, a stagnation line between the pressure and suction sides, and a trailing edge between the pressure and suction sides and downstream from the stagnation line. A first column of overlapping stagnation trench segments is on the exterior surface, and the stagnation line passes through at least a portion of each of the overlapping stagnation trench segments. At least one cooling passage in each stagnation trench segment provides fluid communication from the interior surface to the exterior surface.

20 Claims, 10 Drawing Sheets

AIRFOIL

FIELD OF THE INVENTION

The present invention generally involves an airfoil, such as might be used in a turbine.

BACKGROUND OF THE INVENTION

Turbines are widely used in a variety of aviation, industrial, and power generation applications to perform work. Each turbine generally includes alternating stages of circumferentially mounted stator vanes and rotating blades. Each stator vane and rotating blade may include high alloy steel and/or ceramic material shaped into an airfoil. A compressed working fluid, such as steam, combustion gases, or air, flows across the stator vanes and rotating blades along a gas path in the turbine. The stator vanes accelerate and direct the compressed working fluid onto the subsequent stage of rotating blades to impart motion to the rotating blades and perform work.

High temperatures associated with the compressed working fluid may lead to increased wear and/or damage to the stator vanes and/or rotating blades. As a result, a cooling media may be supplied inside the airfoils and released through the airfoils to provide film cooling to the outside of the airfoils. Trenches in the airfoils evenly distribute the cooling media across the external surface of the airfoils. However, an improved airfoil that varies the distribution of the cooling media across the external surface of the airfoils would be useful.

BRIEF DESCRIPTION OF THE INVENTION

Aspects and advantages of the invention are set forth below in the following description, or may be obvious from the description, or may be learned through practice of the invention.

One embodiment of the present invention is an airfoil that includes an interior surface, an exterior surface opposed to the interior surface, a pressure side, a suction side opposed to the pressure side, a stagnation line between the pressure and suction sides, and a trailing edge between the pressure and suction sides and downstream from the stagnation line. A first column of overlapping stagnation trench segments is on the exterior surface, and the stagnation line passes through at least a portion of each of the overlapping stagnation trench segments. At least one cooling passage in each stagnation trench segment provides fluid communication from the interior surface to the exterior surface.

Another embodiment of the present invention is an airfoil that includes an interior surface, an exterior surface opposed to the interior surface, a pressure side, a suction side opposed to the pressure side, a stagnation line between the pressure and suction sides, and a trailing edge between the pressure and suction sides and downstream from the stagnation line. A second column of overlapping pressure side trench segments is on the pressure side, and a third column of overlapping suction side trench segments is on the suction side. Each pressure side trench segment and each suction side trench segment has a first end and a second end downstream and radially outward from the first end. At least one side cooling passage is in each pressure side trench segment and in each suction side trench segment, and the side cooling passages provide fluid communication from the interior surface to the exterior surface.

In yet another embodiment, an airfoil includes an interior surface, an exterior surface opposed to the interior surface, a pressure side, a suction side opposed to the pressure side, a stagnation line between the pressure and suction sides, and a trailing edge between the pressure and suction sides and downstream from the stagnation line. A first column of overlapping stagnation trench segments is on the exterior surface, and the stagnation line passes through at least a portion of each of the overlapping stagnation trench segments. At least one cooling passage is in each stagnation trench segment and provides fluid communication from the interior surface to the exterior surface. A second column of overlapping pressure side trench segments is on the pressure side, and a third column of overlapping suction side trench segments is on the suction side. At least one side cooling passage is in each pressure side trench segment and in each suction side trench segment to provide fluid communication from the interior surface to the exterior surface.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
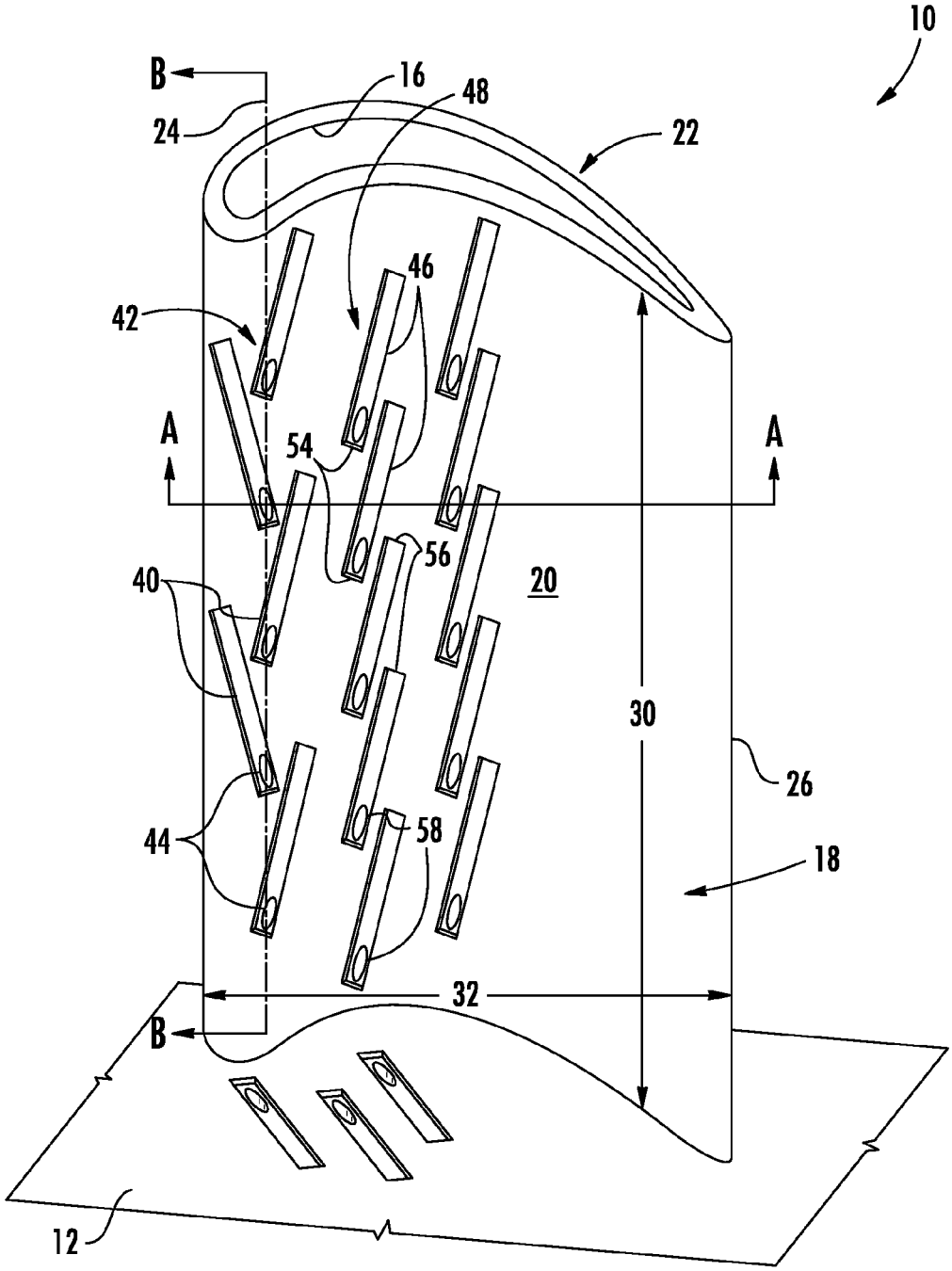
FIG. 1 is a perspective view of an airfoil according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
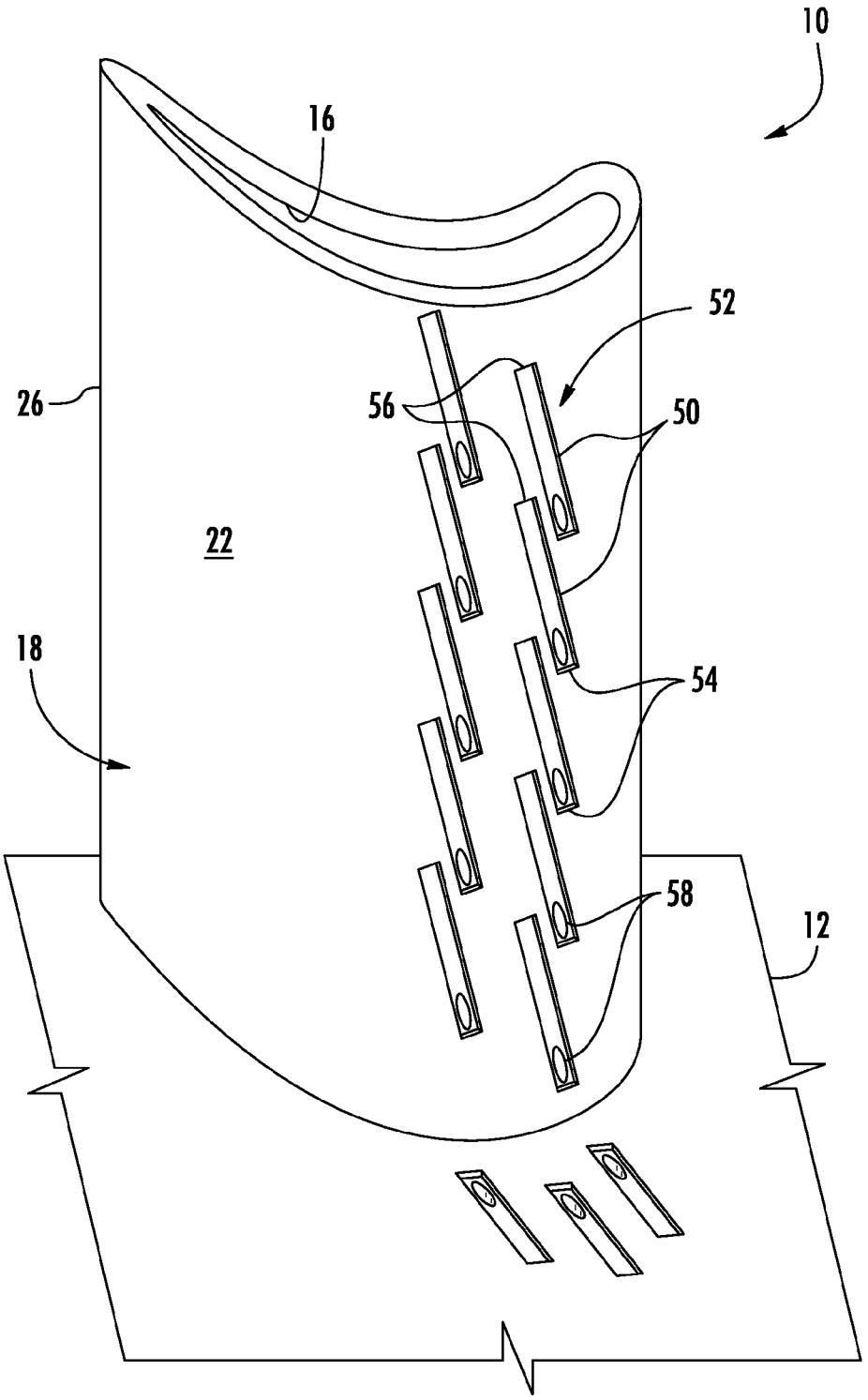
FIG. 2 is a perspective view of the suction side of the airfoil shown in FIG. 1 according to one embodiment of the present invention.

FIG. 1 provides a perspective view of an airfoil 10 according to one embodiment of the present invention, and FIG. 2 provides a perspective view of the suction side of the airfoil shown in FIG. 1. The airfoil 10 may be used, for example, as a rotating blade or stationary vane in a turbine to convert kinetic energy associated with a compressed working fluid into mechanical energy. The compressed working fluid may be steam, combustion gases, air, or any other fluid having kinetic energy. As shown in FIGS. 1 and 2, the airfoil 10 is generally connected to a platform or sidewall 12. The platform or sidewall 12 generally serves as the radial boundary for a gas path inside the turbine and provides an attachment point for the airfoil 10. The airfoil 10 may include an interior surface 16 and an exterior surface 18 opposed to the interior surface 16 and connected to the platform 12. The exterior surface generally includes a pressure side 20 and a suction side 22 opposed to the pressure side 20. As shown in FIGS. 1 and 2, the pressure side 20 is generally concave, and the suction side 22 is generally convex to provide an aerodynamic surface over which the compressed working fluid flows. A stagnation line 24 at a leading edge of the airfoil 10 between the pressure and suction sides 20, 22 represents the dividing line between fluid flow across the pressure side 20 and fluid flow across the suction side 22 of the airfoil 10. The stagnation line 24 often has the highest temperature over the exterior surface 18 of the airfoil 10. A trailing edge 26 is between the pressure and suction sides 20, 22 and downstream from the stagnation line 24. In this manner, the exterior surface 18 creates an aerodynamic surface suitable for converting the kinetic energy associated with the compressed working fluid into mechanical energy.

The exterior surface 18 generally includes a radial length 30 that extends from the platform 12 radially outward and an axial length 32 that extends from the stagnation line 24 to the trailing edge 26. One or more columns of trench segments may extend radially and/or axially in the exterior surface 18, and each trench segment may include at least one cooling passage that provides fluid communication from the interior surface 16 to the exterior surface 18. In this manner, cooling media may be supplied inside the airfoil 10, and the cooling passages allow the cooling media to flow through the airfoil 10 to provide film cooling to the exterior surface 18. The trench segments may be located anywhere on the airfoil 10 and/or platform or sidewall 12, may be straight or arcuate, and may be aligned or staggered with respect to one another. In addition, the trench segments may have varying lengths, widths, and/or depths. The varying lengths, widths, and/or depths of the trench segments alter the distribution of the cooling media across the exterior surface 18. For example, widening the trench segments and making them shallower as they move away from the cooling passages may assist in diffusing the cooling media across the exterior surface 18.

In the particular embodiment shown in FIG. 1, for example, overlapping stagnation trench segments 40 may be arranged in a first column 42 on the exterior surface 18 so that the stagnation line 24 passes through at least a portion of each of the stagnation trench segments 40. Each stagnation trench segment 40 may be substantially straight and canted at an angle with respect to the immediately adjacent stagnation trench segment 40 so that the stagnation trench segments 40 overlap one another radially along the exterior surface 18. As used herein, the term "overlap" means that moving radially outward from the platform 12, the end of one trench segment 40 is radially outward of the beginning of the next trench segment 40 in the same column. At least one cooling passage 44 in each stagnation trench segment 40 may provide fluid communication from the interior surface 16 to the exterior surface 18. In this manner, the cooling passages 44 may provide substantially continuous film cooling through the stagnation trench segments 40 along the stagnation line 24.

Additional overlapping trench segments may be arranged on the pressure and/or suction sides 20, 22 of the exterior surface 18. For example, as shown in FIG. 1, overlapping pressure side trench segments 46 may be arranged in a second column 48 on the pressure side 20 of the exterior surface 18. Alternately or in addition, overlapping suction side trench segments 50 may be arranged in a third column 52 on the suction side 22 of the exterior surface 18, as shown in FIG. 2. Each pressure side trench segment 46 and each suction side trench segment 50 may be canted or angled in the opposite direction. For example, as shown in FIGS. 1 and 2, each pressure side trench segment 46 and/or each suction side trench segment 50 may have a first end 54 and a second end 56 downstream and radially outward from the first end 54. In addition, each pressure side trench segment 46 and/or each suction side trench segment 50 may include one or more side cooling passages 58 that provide fluid communication from the interior surface 16 to the exterior surface 18 to provide film cooling over the pressure and suction sides 20, 22, respectively. In the particular embodiment shown in FIG. 1, the side cooling passages 58 in the pressure side trench segments 46 are radially offset from the cooling passages 44 in the stagnation trench segments 40 to further enhance radial distribution of the cooling media over the exterior surface 18.

Figure 3:
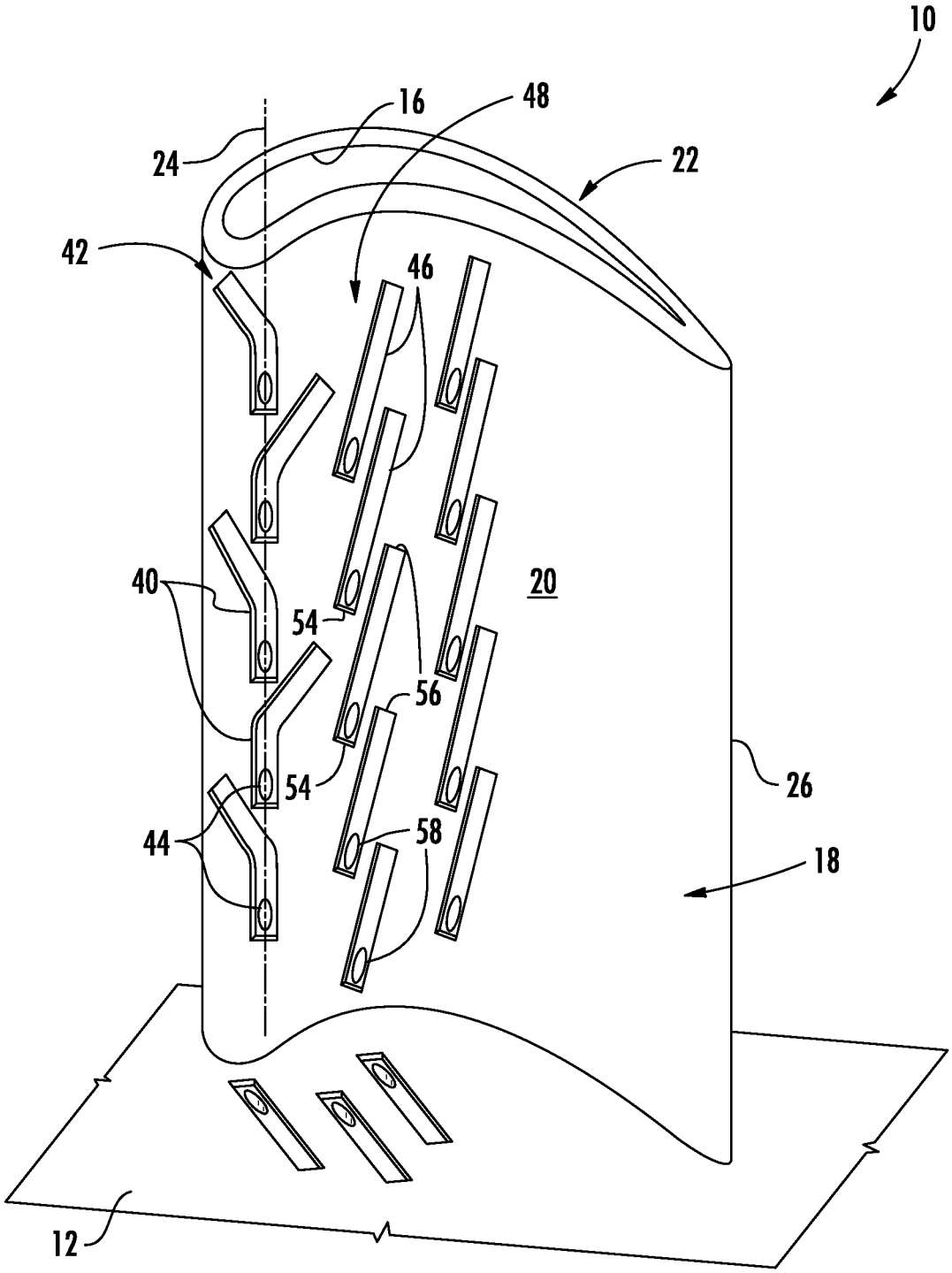
FIG. 3 is a perspective view of an airfoil according to a second embodiment of the present invention.

FIG. 3 provides a perspective view of the airfoil 10 according to a second embodiment of the present invention. As shown, the airfoil 10 again includes the platform or sidewall 12, interior surface 16, exterior surface 18, pressure side 20, suction side 22, overlapping pressure side trench segments 46, and side cooling passages 58 as previously described and illustrated in FIG. 1. In this particular embodiment, the overlapping stagnation trench segments 40 lie along at least a portion of the stagnation line 24 and then curve in alternating directions toward the pressure and suctions sides 20, 22. Alternately or in addition, the stagnation trench segments 40 may include a branch at a discreet angle and then continue as a straight trench. The cooling passages 44 in each stagnation trench segment 40 again provide fluid communication from the interior surface 16 to the exterior surface 18 to enhance film cooling through the stagnation trench segments 40 along the stagnation line 24.

Figure 4:
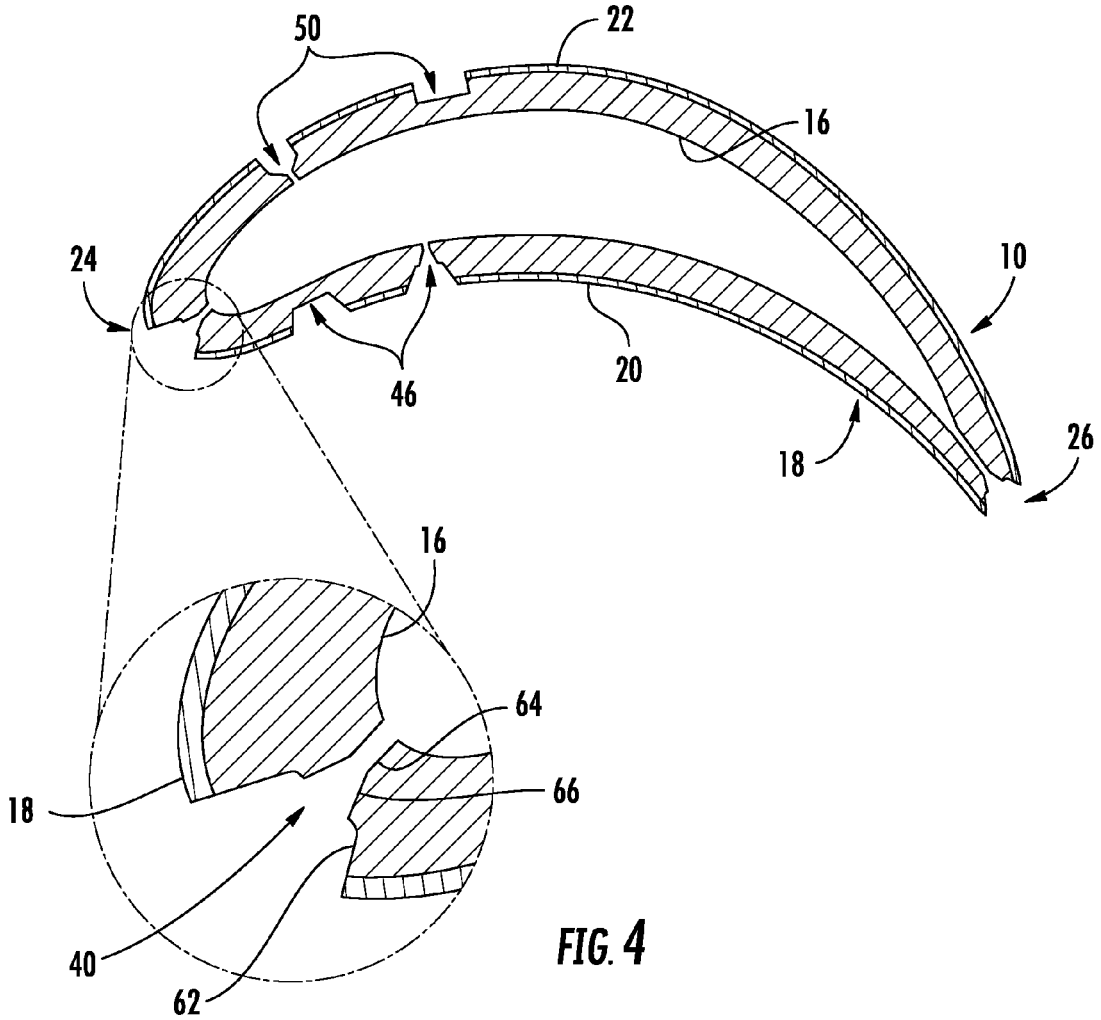
FIG. 4 is an axial cross-section view of the airfoil shown in FIG. 1 taken along line A-A.
Figure 5:
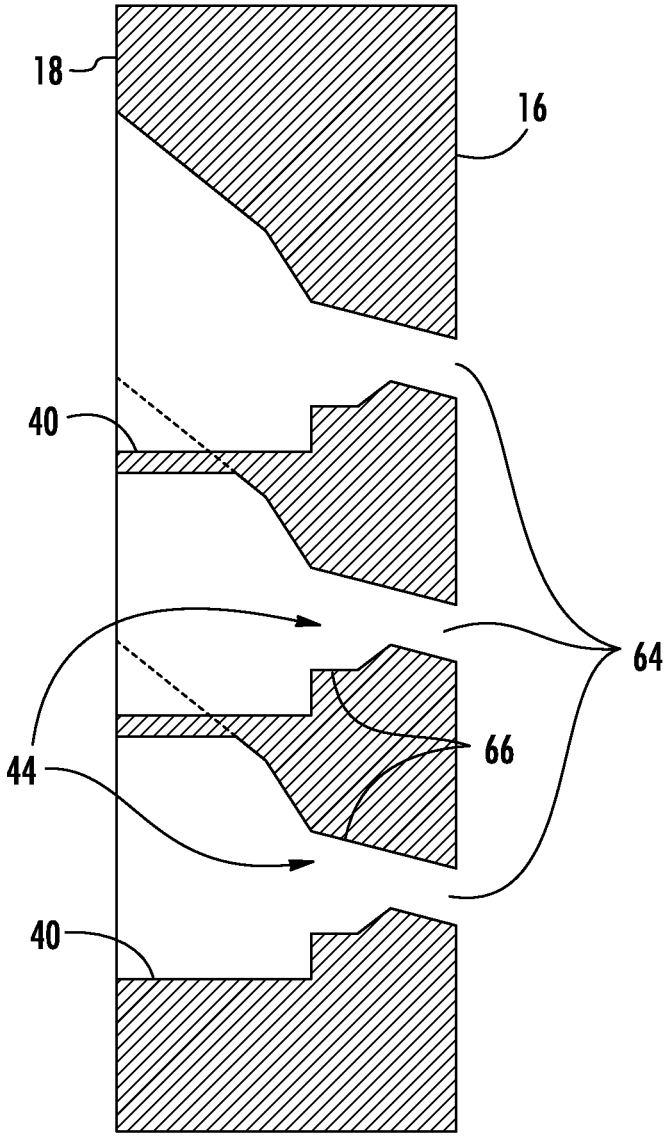
FIG. 5 is a radial cross-section view of the airfoil shown in FIG. 1 taken along line B-B.

FIGS. 4 and 5 provide axial and radial cross-section views of the airfoil 10 shown in FIG. 1 taken along lines A-A and B-B, respectively. As shown most clearly in FIGS. 4 and 5, each trench segment 40, 46, 50 generally includes opposing walls 62 that define a depression or groove in the exterior surface 18. The opposing walls 62 may be straight or curved and may define a constant or varying width for the trench segments 40, 46, 50. The cooling passages 44, 58 in adjacent trench segments 40, 46, 50 may be radially aligned with or offset from one another. Each cooling passage 44, 58 may include a first section 64 that terminates at the interior surface 16 and a second section 66 that terminates at the exterior surface 18. The first section 64 may have a cylindrical shape, and the second section 66 may have a conical or spherical shape. As shown in FIG. 5, the first section 64 may be angled with respect to the second section 66 and/or the trench segment 40, 46, 50 to provide directional flow for the cooling media flowing through the cooling passage 44, 58 and into the trench segment 40, 46, 50. Alternately or in addition, the second section 66 and/or the walls 62 of the trench segment 40, 46, 50 may be asymmetric to preferentially distribute the cooling media across the exterior surface 18.

One or more of the cooling passages 44, 58 may be angled with respect to the trench segments 40, 46, 50 to preferentially direct the cooling media in the trench segments 40, 46, 50. For example, as shown most clearly in FIG. 5, the cooling passages 44 in the stagnation trench segments 40 may be angled radially outward so that the cooling media flows radially outward in the stagnation trench segments 40. In addition, the depth of the stagnation trench segments 40 may gradually decrease and/or the width may gradually increase as the stagnation trench segments 40 extend radially outward. In this manner, the angled cooling passages 44, in combination with the varying width and/or depth of the trench segments 40, enhance the distribution of the cooling media along the exterior surface 18.

Figure 6:
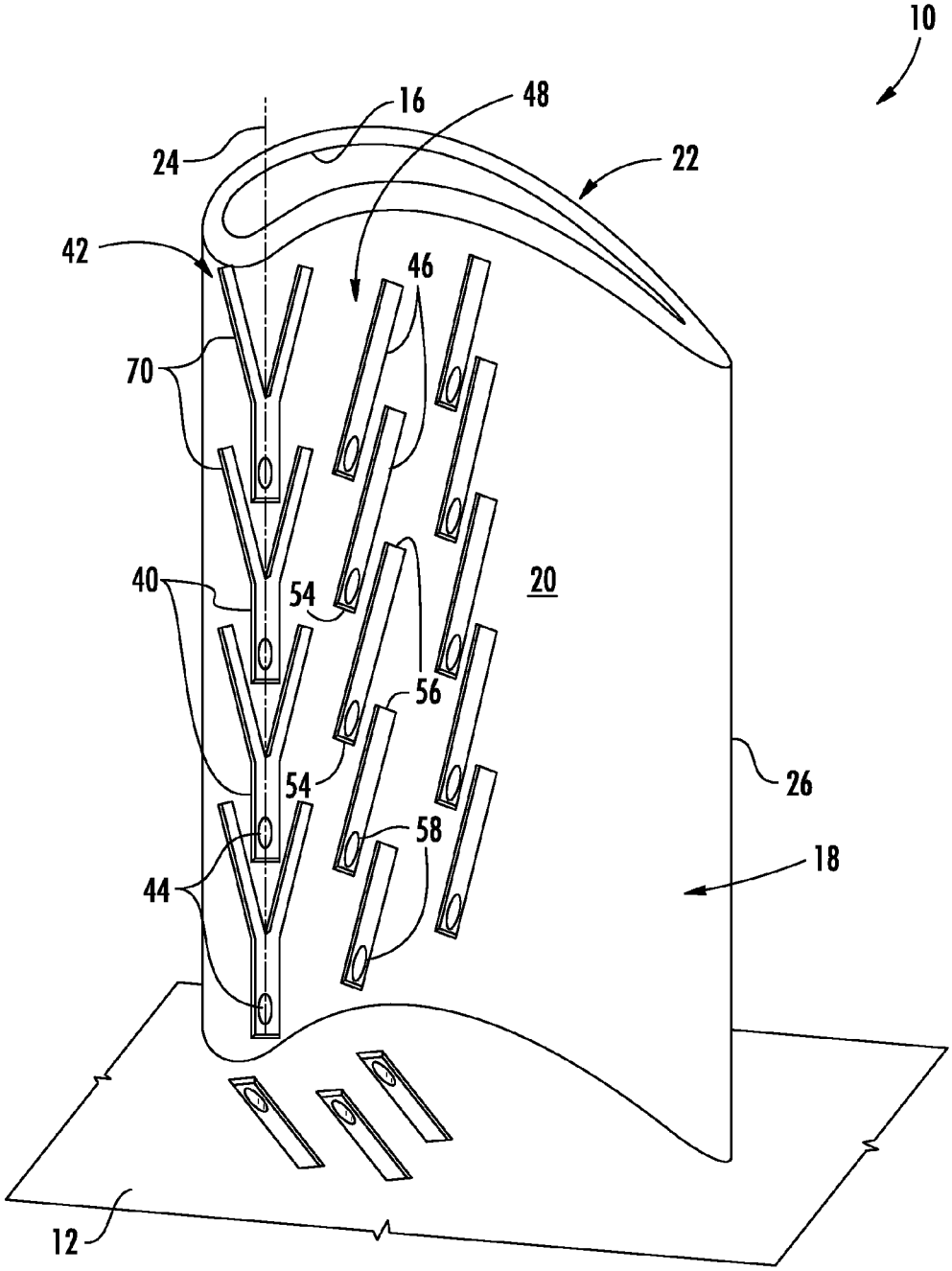
FIG. 6 is a perspective view of an airfoil according to a third embodiment of the present invention.
Figure 7:
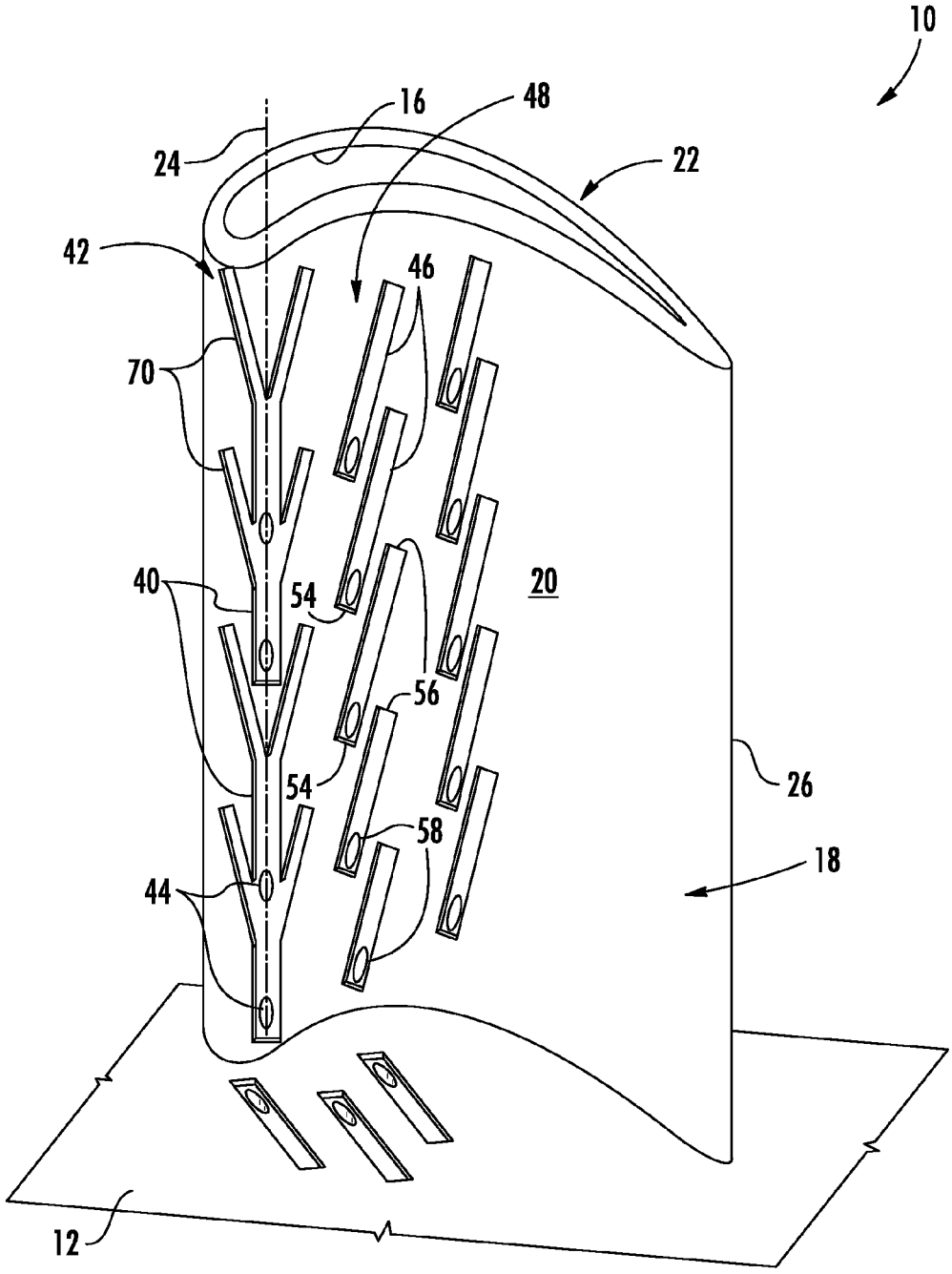
FIG. 7 is a perspective view of an airfoil according to a fourth embodiment of the present invention.
Figure 8:
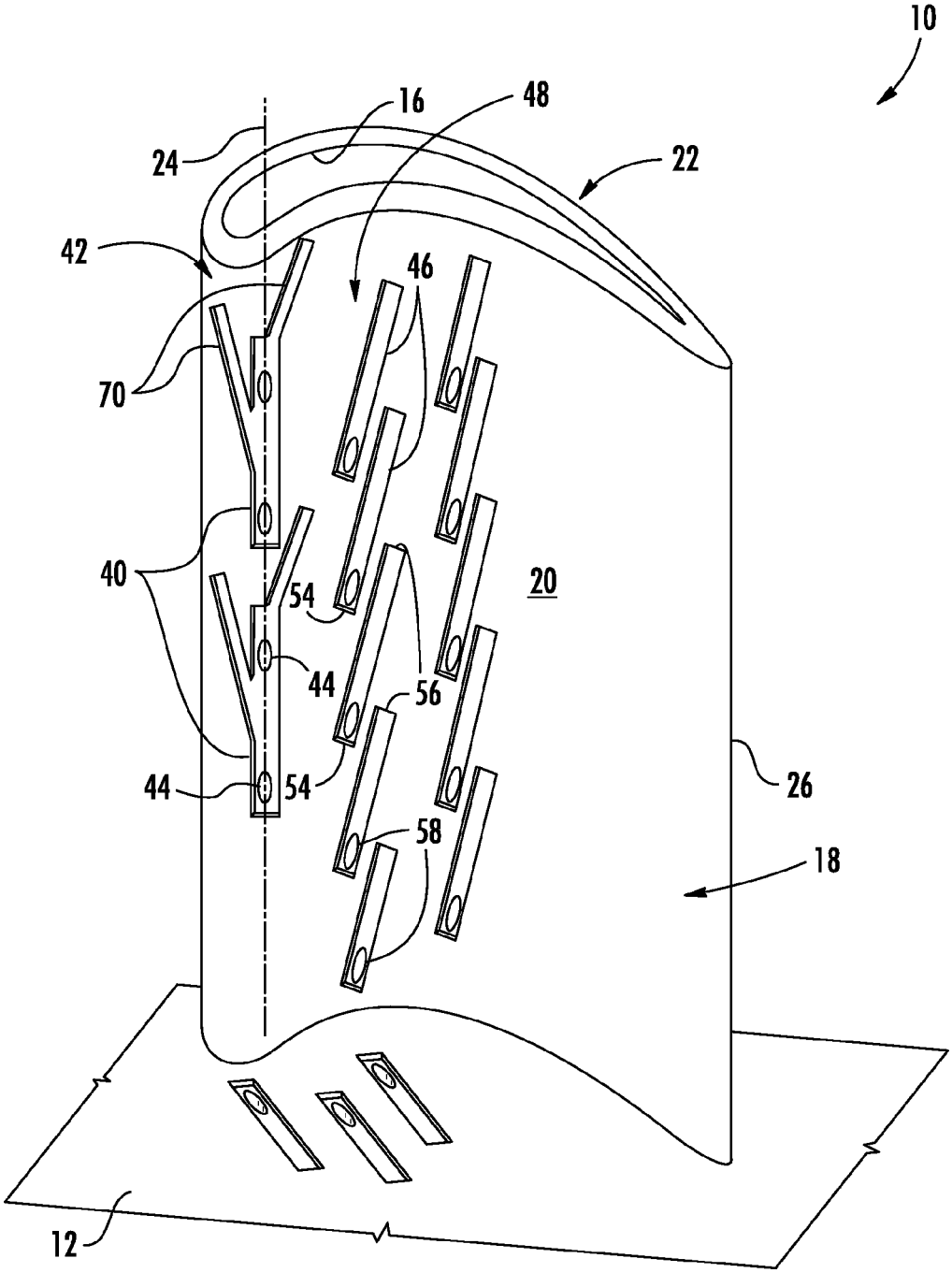
FIG. 8 is a perspective view of an airfoil according to a fifth embodiment of the present invention.

FIGS. 6-8 provide additional embodiments of the stagnation trench segments 40 within the scope of the present invention. In the particular embodiment shown in FIG. 6, each stagnation trench segment 40 again lies along at least a portion of the stagnation line 24 and branch portions 70 extend at angles in opposite directions toward the pressure and suction sides 20, 22 of the airfoil 10. In this manner, the branch portions 70 radially overlap with the next radially outward stagnation trench segment 40 to enhance distribution of the film cooling across the exterior surface 18 of the airfoil 10. In the particular embodiment shown in FIG. 7, each stagnation trench segment 40 again includes the branch portions 70 that extend at angles in opposite directions toward the pressure and suction sides 20, 22 of the airfoil 10, as previously shown in FIG. 6. In addition, two or more of the stagnation trench segments 40 are joined together, creating a longer stagnation trench segment 40 with multiple cooling passages 44 and branch portions 70. In the particular embodiment shown in FIG. 8, each stagnation trench segment 40 again includes the branch portions 70; however, the branch portions 70 extend at angles in alternating directions toward the pressure and suction sides 20, 22 of the airfoil 10. As further shown in FIG. 8, the stagnation trench segment 40 may include multiple cooling passages 44, with each cooling passage located radially between consecutive branch portions 70.

Figure 9:
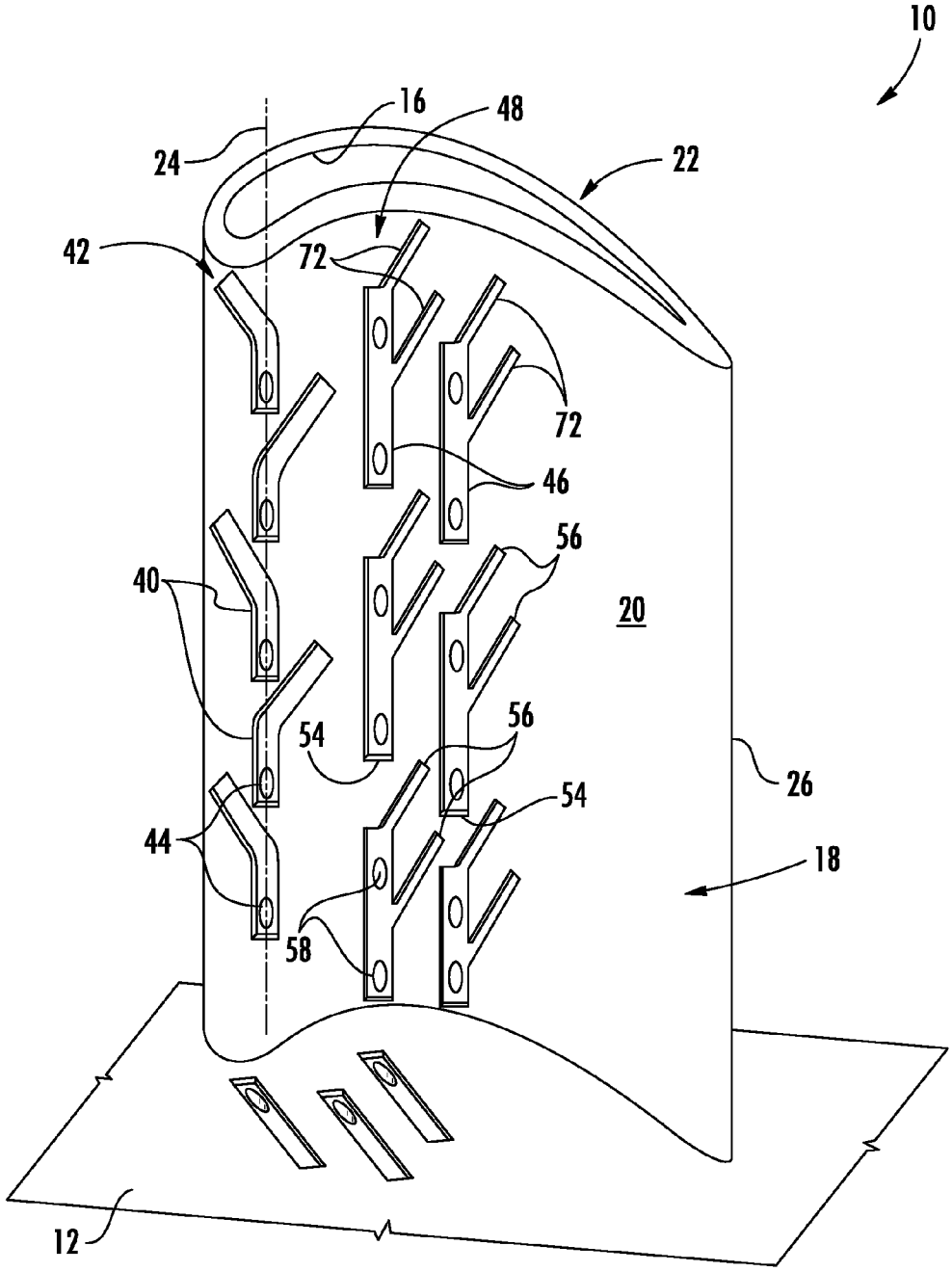
FIG. 9 is a perspective view of an airfoil according to a sixth embodiment of the present invention.

FIG. 9 provides an additional embodiment of the pressure side trench segments 46 that may or may not be incorporated into any of the previous embodiments. As shown in FIG. 9, the overlapping pressure side trench segments 46 may be aligned substantially perpendicular to the direction of airflow across the airfoil 10, and each pressure side trench segment 46 may further include one or more branch portions 72 that extend at an angle toward the trailing edge 26. In this manner, the branch portions 72 radially overlap with the next radially outward pressure side trench segment 46 to enhance distribution of the film cooling across the pressure side 20 of the airfoil 10. Alternately or in addition, the airfoil 10 may similarly include suction side trench segments 50 with similar branch portions 72 that extend at an angle toward the trailing edge 26 on the suction side 22 of the exterior surface 18. One of ordinary skill in the art will readily appreciate from the teachings herein that still further embodiments within the scope of the present invention may include one or more of the features previously described with respect to the embodiments shown in FIGS. 1-5.

Figure 10:
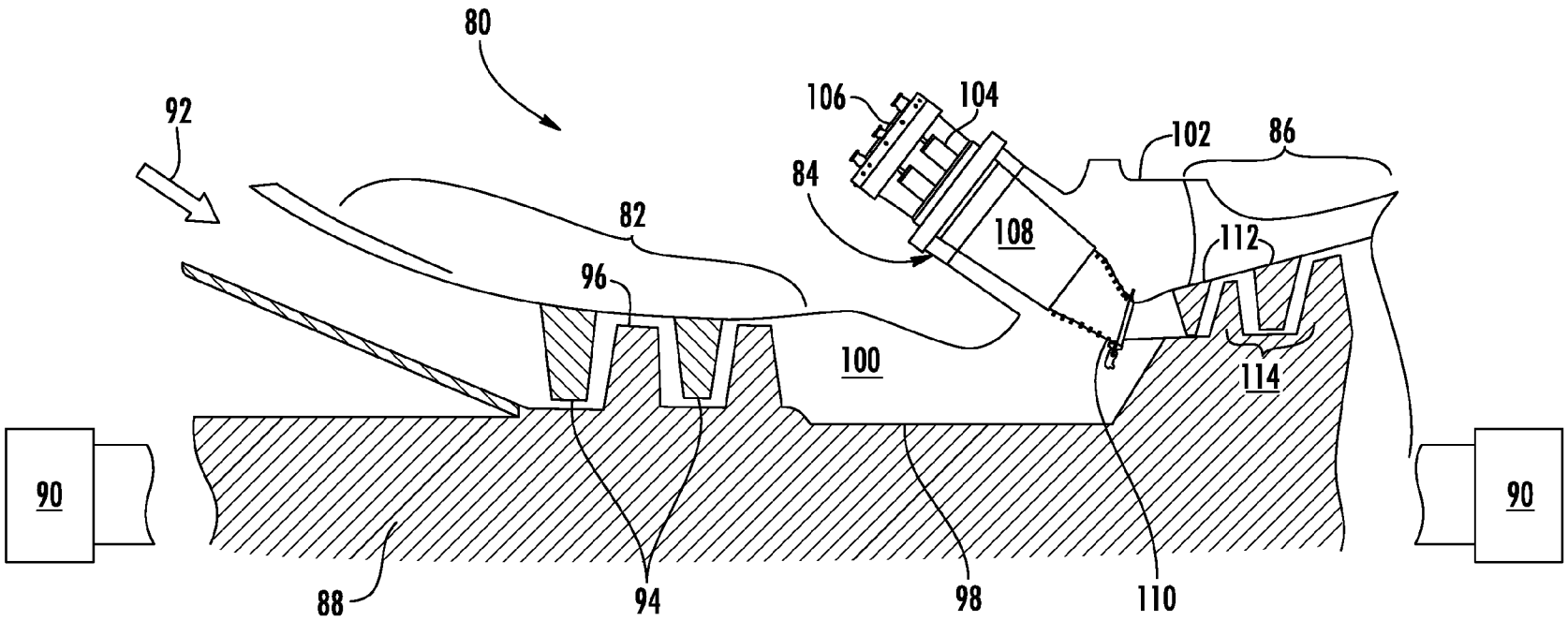
FIG. 10 is a cross section view of an exemplary gas turbine incorporating any embodiment of the present invention.

FIG. 10 provides a simplified cross-section view of an exemplary gas turbine 80 that may incorporate various embodiments of the present invention. As shown, the gas turbine 80 may generally include a compressor section 82 at the front, a combustion section 84 radially disposed around the middle, and a turbine section 86 at the rear. The compressor section 82 and the turbine section 86 may share a common rotor 88 connected to a generator 90 to produce electricity.

The compressor section 82 may include an axial flow compressor in which a working fluid 92, such as ambient air, enters the compressor and passes through alternating stages of stationary vanes 94 and rotating blades 96. A compressor casing 98 may contain the working fluid 92 as the stationary vanes 94 and rotating blades 96 accelerate and redirect the working fluid 92 to produce a continuous flow of compressed working fluid 92. The majority of the compressed working fluid 92 flows through a compressor discharge plenum 100 to the combustion section 84.

The combustion section 84 may include any type of combustor known in the art. For example, as shown in FIG. 10, a combustor casing 102 may circumferentially surround some or all of the combustion section 84 to contain the compressed working fluid 92 flowing from the compressor section 82. One or more fuel nozzles 104 may be radially arranged in an end cover 106 to supply fuel to a combustion chamber 108 downstream from the fuel nozzles 104. Possible fuels include, for example, one or more of blast furnace gas, coke oven gas, natural gas, vaporized liquefied natural gas (LNG), hydrogen, and propane. The compressed working fluid 92 may flow from the compressor discharge passage 100 along the outside of the combustion chamber 108 before reaching the end cover 106 and reversing direction to flow through the fuel nozzles 104 to mix with the fuel. The mixture of fuel and compressed working fluid 92 flows into the combustion chamber 108 where it ignites to generate combustion gases having a high temperature and pressure. A transition duct 110 circumferentially surrounds at least a portion of the combustion chamber 108, and the combustion gases flow through the transition duct 110 to the turbine section 86.

The turbine section 86 may include alternating stages of rotating buckets 112 and stationary nozzles 114. As will be described in more detail, the transition duct 110 redirects and focuses the combustion gases onto the first stage of rotating buckets 112. As the combustion gases pass over the first stage of rotating buckets 112, the combustion gases expand, causing the rotating buckets 112 and rotor 88 to rotate. The combustion gases then flow to the next stage of stationary nozzles 114 which redirect the combustion gases to the next stage of rotating buckets 112, and the process repeats for the following stages.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An airfoil, comprising:

a. an interior surface;

b. an exterior surface opposed to the interior surface, wherein the exterior surface comprises a pressure side, a suction side opposed to the pressure side, a stagnation line between the pressure and suction sides, and a trailing edge between the pressure and suction sides and downstream from the stagnation line;

c. a plurality of stagnation trench segments forming a radial column of stagnation trench segments on the exterior surface, wherein the stagnation line passes through at least a portion of each of the stagnation trench segments, the plurality of stagnation trench segments comprising a first stagnation trench segment having a first end radially and axially spaced from a second end, and a second stagnation trench segment radially adjacent to the first stagnation trench segment and having a first end radially and axially spaced from a second end, wherein the second end of the first stagnation trench segment radially overlap with the first end of the second stagnant trench segment; and d. at least one cooling passage in each stagnation trench segment, wherein the cooling passages provide fluid communication from the interior surface to the exterior surface.

2. The airfoil as in claim 1, wherein at least one stagnation trench segment is arcuate.

3. The airfoil as in claim 1, wherein at least one stagnation trench segment has a varying dimension along a length of the at least one stagnation trench segment.

4. The airfoil as in claim 1, wherein at least one stagnation trench segment has a decreasing dimension, and the at least one cooling passage in the at least one stagnation trench segment is angled toward the decreasing dimension.

5. The airfoil as in claim 1, further comprising a column of overlapping pressure side trench segments on the pressure side.

6. The airfoil as in claim 5, further comprising a column of overlapping suction side trench segments on the suction side.

7. The airfoil as in claim 5, further comprising at least one side cooling passage in each pressure side trench segment, wherein the side cooling passages provide fluid communication from the interior surface to the exterior surface.

8. The airfoil as in claim 7, wherein the side cooling passages in the pressure side trench segments are radially offset from the cooling passages in the stagnation trench segments.

9. An airfoil, comprising:

a. an interior surface;

b. an exterior surface opposed to the interior surface, wherein the exterior surface comprises a pressure side, a suction side opposed to the pressure side, a stagnation line between the pressure and suction sides, and a trailing edge between the pressure and suction sides and downstream from the stagnation line;

c. a plurality of pressure side trench segments on the pressure side forming a radial column of pressure side trench segments, the plurality of pressure side trench segments comprising a first pressure side trench segment having a first end radially and axially spaced from a second end, and a second pressure side trench segment radially adjacent to the first pressure side trench segment and having a first end radially and axially spaced from a second end, wherein the second end of the first pressure side trench segment radially overlaps with the first end of the second pressure side trench segment;

d. a plurality of suction side trench segments on the suction side forming a radial column of suction side trench segments, the plurality of suction side trench segments comprising a first suction side trench segment having a first end radially and axially spaced from a second end, and a second suction side trench segment radially adjacent to the first suction side trench segment and having a first end radially and axially spaced from a second end, wherein the second end of the first suction side trench segment radially overlaps with the first end of the second suction side trench segment; and e.

f. at least one side cooling passage in each pressure side trench segment and in each suction side trench segment, wherein the side cooling passages provide fluid communication from the interior surface to the exterior surface.

10. The airfoil as in claim 9, further comprising a column of overlapping stagnation trench segments on the exterior surface, wherein the stagnation line passes through at least a portion of each of the overlapping stagnation trench segments.

11. The airfoil as in claim. 10, wherein at least one stagnation trench segment is arcuate.

12. The airfoil as in claim 10, wherein at least one stagnation trench segment has a varying dimension along a length of the at least one stagnation trench segment.

13. The airfoil as in claim 10, wherein at least one stagnation trench segment has a decreasing dimension, and the at least one cooling passage in the at least one stagnation trench segment is angled toward the decreasing dimension.

14. The airfoil as in claim 10, further comprising at least one cooling passage in each stagnation trench segment, wherein the at least one cooling passage provides fluid communication from the interior surface to the exterior surface.

15. The airfoil as in claim 14, wherein the side cooling passages in the pressure side trench segments are radially offset from the cooling passages in the stagnation trench segments.

16. An airfoil, comprising:

a. an interior surface;

b. an exterior surface opposed to the interior surface, wherein the exterior surface comprises a pressure side, a suction side opposed to the pressure side, a stagnation line between the pressure and suction sides, and a trailing edge between the pressure and suction sides and downstream from the stagnation line;

c. a plurality of stagnation trench segments forming a radial column of stagnation trench segments on the exterior surface, wherein the stagnation line passes through at least a portion of each of the stagnation trench segments, the plurality of stagnation trench segments comprising a first stagnation trench segment having a first end radially and axially spaced from a second end, and a second stagnation trench segment radially adjacent to the first stagnation trench segment and having a first end radially and axially spaced from a second end, wherein the second end of the first stagnation trench segment radially overlaps with the first end of the second stagnant trench segment;

d. at least one cooling passage in each stagnation trench segment, wherein the at least one cooling passage provides fluid communication from the interior surface to the exterior surface;

e. a plurality of pressure side trench segments on the pressure side forming a radial column of pressure side trench segments, the plurality of pressure side trench segments comprising a first pressure side trench segment having a first end radially and axially spaced from a second end, and a second pressure side trench segment radially adjacent to the first pressure side trench segment and having a first end radially and axially spaced from a second end, wherein the second end of the first pressure side trench segment radially overlaps with the first end of the second pressure side trench segment;

f. a plurality of suction side trench segments on the suction side forming a radial column of suction side trench segments, the plurality of suction side trench segments comprising a first suction side trench segment having a first end radially and axially spaced from a second end, and a second suction side trench segment radially adjacent to the first suction side trench segment and having a first end radially and axially spaced from a second end, wherein the second end of the first suction side trench segment radially overlaps with the first end of the second suction side trench segment; and g. at least one side cooling passage in each pressure side trench segment and in each suction side trench segment, wherein the side cooling passages provide fluid communication from the interior surface to the exterior surface.

17. The airfoil as in claim 16, wherein at least one stagnation trench segment is arcuate.

18. The airfoil as in claim 16, wherein at least one stagnation trench segment has a varying dimension along a length of the at least one stagnation trench segment.

19. The airfoil as in claim 16, wherein at least one stagnation trench segment has a decreasing dimension, and the at least one cooling passage in the at least one stagnation trench segment is angled toward the decreasing dimension.

20. The airfoil as in claim 16, wherein the side cooling passages in the pressure side trench segments are radially offset from the cooling passages in the stagnation trench segments.

* * * * *

UNITED STATES PATENT AND TRADEMARK OFFICE

CERTIFICATE OF CORRECTION

PATENT NO. : 9,080,451 B2
APPLICATION NO. : 13/535540
DATED : July 14, 2015
INVENTOR(S) : Stanley Frank Simpson and Benjamin Paul Lacy It is certified that error appears in the above-identified patent and that said Letters Patent is hereby corrected as shown below:

In the claims

Claim 1, column 7, line 22, reads "overlap with the first end" should read --overlaps with the first end--

Claim 9, column 8, line 13, reads "f." should read --e.--

Claim 11, column 8, line 22, reads "The airfoil as in claim.10," should read --The airfoil as in claim 10,--

Signed and Sealed this
Thirty-first Day of May, 2016

Michelle K. Lee

Michelle K. Lee
*Director of the United States Patent and Trademark Office*